United States Patent [19]

Woolley

[11] Patent Number: 4,862,210

[45] Date of Patent: Aug. 29, 1989

[54] REPLACEABLE SEAL ASSEMBLY FOR TONER CARTIDGES AND METHOD OF USE

[75] Inventor: Lee G. Woolley, El Paso County, Colo.

[73] Assignee: Access Computer Products, Inc., Ann Arbor, Mich.

[21] Appl. No.: 160,558

[22] Filed: Feb. 25, 1988

[51] Int. Cl.[4] ..... G03G 15/00; B65B 1/04; B65B 3/04; B65B 31/00

[52] U.S. Cl. ..... 355/245; 141/18; 222/165; 222/609; 222/DIG. 1; 355/260

[58] Field of Search ..... 355/3 R, 3 DD, 15, 133; 141/1, 18, 84, 98; 206/206, 601, 524.1, 525, 816; 222/147, 153, 165, 325, 564, 609, DIG. 1

[56] References Cited

U.S. PATENT DOCUMENTS

| | | | |
|---|---|---|---|
| 4,456,154 | 6/1984 | Herriman | 222/484 |
| 4,538,651 | 9/1985 | Lykins | 141/1 |
| 4,614,286 | 9/1986 | Yamaguchi et al. | 222/505 |
| 4,615,608 | 10/1986 | Mizutani | 222/DIG. 1 X |
| 4,650,070 | 3/1987 | Oka et al. | 206/216 |

OTHER PUBLICATIONS

PC Magazine, Jan. 12, 1988, p. 447.

*Primary Examiner*—A. T. Grimley
*Assistant Examiner*—Edward Pipala
*Attorney, Agent, or Firm*—Henderson & Sturm

[57] ABSTRACT

A replaceable seal assembly (10) for a used Canon brand developer station (100) having a peripheral recess (106) created by the removal of the original toner reservoir seal; wherein, the seal assembly (10) having a seal unit (11) including a generally rigid seal member (13) having a generally flexible seal member (14); and, a bracket unit (12) which is adapted to frictionally engage the generally rigid seal member (13) relative to the peripheral recess (106); whereby, the seal unit (11) may be inserted and removed from said peripheral recess (106) in the course of recharging the developer station (100) with fresh toner.

8 Claims, 1 Drawing Sheet

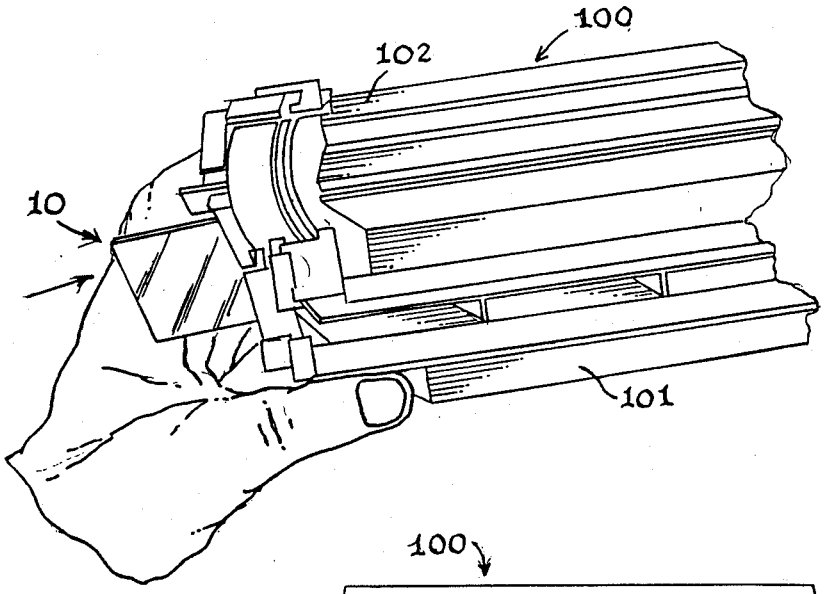
FIG. 1.
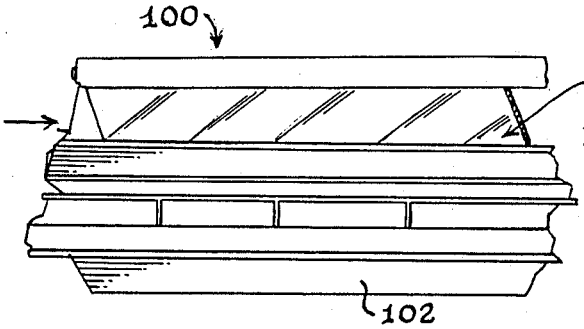
FIG. 8.
FIG. 2.
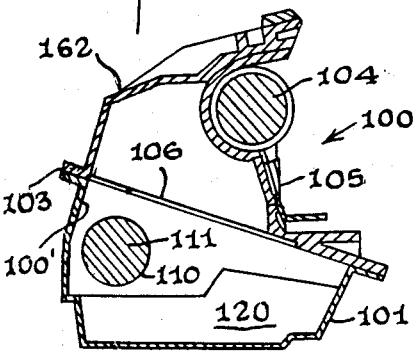
FIG. 3.
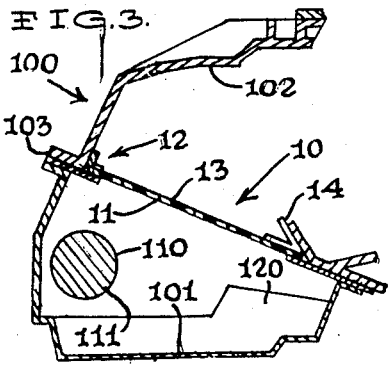
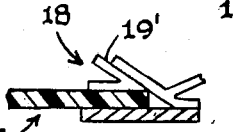
FIG. 6.
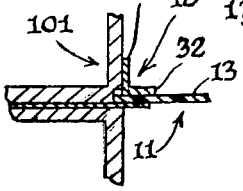
FIG. 7.
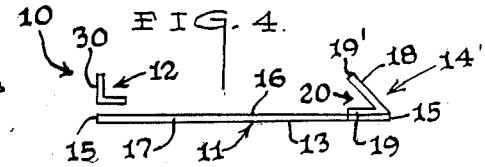
FIG. 4.
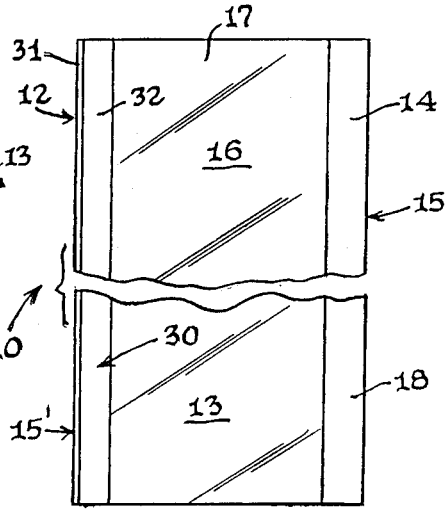
FIG. 5.

REPLACEABLE SEAL ASSEMBLY FOR TONER CARTIDGES AND METHOD OF USE

TECHNICAL FIELD

The present invention relates generally to toner cartridges for photocopying machines, and in particular to a sealing system used to modify and recharge a toner cartridge so that the cartridge becomes reuseable.

BACKGROUND OF THE INVENTION

As can be seen by reference to the following U.S. Pat. Nos. 4,650,070; 4,456,154; 4,538,651; and 4,614,286, the prior art is replete with myriad and diverse toner cartridge constructions developed for use in different photocopying machines.

While the prior art constructions are more than adequate for the purpose and function for which they were specifically designed, they share a number of inadequacies.

Toner cartridges used in electro photographic copiers are structured quite differently from one another depending on the particular machine in which the cartridge is intended for use. In addition, many toner cartridges are single use cartridges, which are disposed of after the toner supply is depleted. It should be obvious therefore, that structural resources could be preserved and operating costs could be reduced if these cartridges could be refilled and reused on a regular basis.

Furthermore, a method of recharging toner cartridges would be exceptionally useful particularly if the basic structure employed was adaptable to several different types of toner cartridges.

Obviously there has existed a long standing need for a toner cartridge conversion device which incorporates both widespread adaptability and a superior level of reusability to at least one major line of photocopiers. The development of such a device is the stated purpose and objective of the present invention.

BRIEF SUMMARY OF THE INVENTION

In order to gain a true appreciation for the replaceable seal assembly that forms the heart of this invention, it will first be necessary to understand that the seal assembly in question was specifically developed for use in Canon brand copier and laser printing developer cartridges.

A typical Canon brand developer cartridge comprises five major components: a drum, a corona wire; a developer station; a take up or wiper section that physically cleans the drum after the printing cycle has begun; and, a casing housing which supports the other components in their operative relationship.

Under the present operating guidelines, once the toner supply is depleted from the developer station the entire developer cartridge is intended to be thrown away and replaced with a new developer cartridge. Obviously this situation results in a very wasteful practice; in that the other structural components of the developer cartridge have their useful lives foreshortened based on the arbitrary time span that is required to deplete the toner supply within the developer station.

Given the fact that the only practical way to effect the recharging of a conventional Canon development cartridge involves the introduction of a fresh supply of toner into the developer station; a means of temporarily sealing the developer station from the remainder of the developer cartridge was required; and, that sealing means forms an integral part of the present invention.

In order to effect the recharging of the developer cartridge it is first necessary to dismantle the aforementioned major components that comprise the developer cartridge to isolate the developer station. The Canon brand developer station comprises in general a developer housing, an aluminum roller, a magnet which fits inside the aluminum roller, a metering blade to adjust or measure out the toner so that the toner is evenly spread on the roller; and, end caps which cooperate with the developer housing to form a reservoir for the toner.

The normal orientation of the developer station within the developer cartridge is such that the toner reservoir is positioned above the aluminum roller and in open communication therewith; such that the toner falls by gravity onto the back side of the roller. At this juncture the roller rotates past the metering blade such that a uniform coating of toner is maintained on the surface of the roller as it exits from the developer station.

In the original manufacturing process of the Canon brand cartridges, the housings for the roller and the toner reservoir are manufactured separately and then ultimately heat welded together. The original seal for the toner reservoir comprises a thin vinyl strip of plastic that is heat fused on a seal plate which extends around the perimeter of the toner reservoir prior to the operative connection of the roller housing to the reservoir housing. Then the reservoir housing is heat welded to the roller housing and these housings for all practical purposes become one unit; wherein the seal plate is disposed intermediate the juncture of the roller housing and the reservoir housing.

When the new cartridge is ready to be used by the customer, the original toner reservoir seal is manually removed, thereby exposing a peripheral recess that had been created between the reservoir housing the roller housing to accommodate the original reservoir seal. This peripheral recess or cavity as will be explained in greater detail further on in the specification becomes crucial to the recharging and sealing aspects of the present invention. Obviously once the original reservoir seal has been removed there is nothing to prevent the toner from getting into the remainder of the cartridge system; and, thus a replacement sealing means must be employed in order to enable the developing station to be recharged with toner and thereby be suitable for recycling.

Briefly stated, the seal assembly that forms the basis of the present invention comprises in general a seal unit and a bracket unit; wherein the seal unit includes a generally rigid seal member having a generally flexible seal member disposed on one end of the generally rigid seal member; and wherein the bracket unit cooperates with the other end of the generally rigid seal member; whereby, the seal assembly of this invention may be operatively engaged and disengaged in the recess that was formerly occupied by the original toner seal in the Canon brand cartridges.

This replacement seal assembly therefore permits the Canon brand cartridges to be refilled with toner; wherein, the toner is temporarily retained in the toner reservoir until such time as the customer wishes to recycle the recharged cartridge; as opposed to simply disposing of the toner spent Canon brand cartridge as is the current practice.

BRIEF SUMMARY OF THE DRAWINGS

These and other objects, advantages, and novel features of this invention will become apparent from the detailed description of the best mode for carrying out the preferred embodiment of this invention which follows; particularly when considered in conjunction with the accompanying drawings, wherein:

FIG. 1 is a perspective view of the seal assembly of this invention inserted into a Canon brand developer cartridge;

FIG. 2 is a cross-sectional view of the developer station in a Canon brand developer cartridge;

FIG. 3 is the same cross-sectional view of FIG. 2 with the seal assembly of this invention installed in the developer station;

FIG. 4 is a side view of the seal assembly of this invention;

FIG. 5 is a top plan view of the seal assembly;

FIG. 6 is an enlarged detail view of the operative engagement of one side of the seal assembly;

FIG. 7 is an enlarged detail view of the operative engagement of the other side of the seal assembly; and, FIG. 8 is a perspective view of the seal assembly installed in the developer station with a portion of the developer housing removed as in FIG. 3.

BEST MODE FOR CARRYING OUT THE INVENTION

As can best be seen by reference to FIGS. 1 thru 3, the replaceable seal assembly that forms the basis of the present invention, and which is designated generally by the reference numeral (10), was developed specifically for use in a used developer station (100) of a Canon brand developer cartridge. Turning particularly to FIG. 2 it can be seen that the used developer station (100) of a Canon brand cartridge comprises in part a toner reservoir housing (101) and a roller housing (102) which are operatively joined together along a common seam (103). In addition, the roller housing (102) comprises in part: a roller element (104); and, a wiper blade element (105) that are suspended and supported within the roller housing (102) in an operative disposition.

As mentioned earlier in the specification, a peripheral recess (106) is formed intermediate the juncture of the roller housing (102) and the toner reservoir housing (101). This recess (106) as also explained earlier was formerly occupied by the original reservoir housing seal (not shown), which prevented the toner that was contained within the toner reservoir housing (101) from falling by gravity into the roller housing (102) until the customer wished to initially commence the active deployment of the developer station (100) whereupon the original toner seal (not shown) would be removed to create the recess (106).

As can be seen by reference to FIGS. 4 and 5, the seal assembly (10) that forms the basis of this invention comprises in general a seal unit (11) and a bracket unit (12). These units will now be described in seriatim fashion. The seal unit (11) comprises an elongated rectangular generally rigid sealing member (13) and a generally flexible sealing member (14); wherein the generally flexible sealing member (14) is disposed along one of the longitudinal edges (15) of the top (16) of the generally rigid sealing member (12).

In addition, the generally rigid sealing member (13) of the preferred embodiment of this invention comprises a thin elongated rectangular strip (17) of generally rigid material such as mylar, or other rigid plastic. Given the dimensions of the peripheral recess (106) in the developer station (100) the dimensions of the generally rigid sealing member should be approximately equal to the following values: thickness 0.030"; length 11-$\frac{7}{8}$"; and, width 1-$\frac{7}{8}$". For the purposes of illustration only these values have been greatly distorted in the accompanying drawings.

The generally flexible sealing member (14) comprises an elongated generally V-shaped flexible sealing element (18); wherein, one of the legs (19) of the sealing element (18) is secured along the top (16) of one longitudinal edge (15) of the generally rigid sealing member (13); and, wherein the opening (20) of the generally V-shaped sealing element (18) faces in the direction of the other edge (15') of the generally rigid sealing member (13).

In the preferred embodiment of this invention, the generally flexible sealing element (18) is fabricated from an elongated strip of pliable vinyl material which is folded to form the V-shaped configuration and which has an overall width of approximately $\frac{7}{8}$". However, it is also to be understood that in keeping with the teachings of this invention other suitable materials and dimensions could be substituted for the generally flexible sealing element (18) heretofore described herein.

As can best be appreciated by reference to FIGS. 4 and 7, the bracket unit (12) comprises an elongated L-shaped bracket member (30) having a generally vertical leg segment (31) and a generally horizontal foot segment (32); wherein, the vertical leg segment (31) is adapted to operatively engage an interior wall (100' ) of the developer station (100); and, wherein the foot segment (32) is adapted to operatively engage the top (16) of the seal unit (11) proximate the longitudinal edge (15' ) that is opposite the generally flexible sealing member (18).

Turning now to FIGS. 6 and 7, it can be seen that the recess (106) in the developer housing is defined by an upper (107) and a lower (108) ledge; wherein the right hand portion (FIG. 6) of the seal unit (11) in its engaged disposition has the bottom (16' ) of the generally rigid sealing member (13) resting on the lower ledge (108) of the recess (106); and, the free leg (19' ) of the generally flexible sealing element (18) operatively engaged with the upper ledge (107) of the recess (106).

In FIG. 7, it can be seen that the vertical leg (31) of the L-shaped bracket member (30) is secured to the wall of the reservoir housing (101), to frictionally engage the left hand side of the generally rigid sealing member (13) intermediate the horizontal foot segment (32) and the lower ledge (108) of the recess (106). It should also be noted that both of the longitudinal edges (15)(15' ) of the sealing unit (11) are only frictionally engaged in the recess (106) and as a consequence the sealing unit (11) may be easily inserted and removed from within the bracket modified reservoir housing (101) for purposes that will explained presently.

Turning once more to FIGS. 2 and 3, it can be seen that the toner reservoir housing (101) is provided with a toner inlet port (110) that is controlled by a closure element (111). When the developer station (100) is first constructed and the original toner seal (not shown) occupies the recess (106), toner is introduced through the toner inlet port to fill the interior (120) of the toner reservoir housing (101).

Now with the development of the reusable seal assembly (10) of this invention, the interior (120) of the reservoir housing (101) may once again be filled with fresh toner to recharge the developer station (100). It should also be noted at this juncture that while the initial installation of the seal assembly (10) in the developer station (100) requires the removal of the roller assembly (104) and the metering blade assembly (105); in order to install the bracket unit (12) at the proper location relative to the reservoir housing (101) and the seal unit (11). Once the bracket unit (12) is operatively disposed in the developer station (100), the roller (104) and metering blade (105) assemblies may remain in place during subsequent recharging of the developer station (100).

Having thereby described the subject matter of this invention it should be apparent that many substitutions, modification, and variations of the invention are possible in light of the above teachings. It is therefore to be understood that the invention as taught and described therein is only to be limited to the extent of the breadth and scope of the appended claims.

I claim:

1. In a used developer station wherein the unused developer station originally comprised: a toner reservoir housing having a toner inlet port and an original toner reservoir seal; and, a roller housing joined along its common edges with the toner reservoir housing wherein the roller housing includes a roller assembly, and a metering blade assembly; and, wherein the removal of the original toner reservoir seal converts the new developer station to a used developer station and creates a peripheral recess in the interior walls of the developer station wherein the recess is defined by an upper ledge and a lower ledge, an improvement comprising:

a seal assembly including a seal unit wherein the seal unit comprises a generally rigid seal member that is dimensioned to be received, removed and reengaged on the peripheral recess in said used developer station.

2. The improvement as in claim 1, wherein the generally rigid seal member comprises a thin flat elongated rectangular strip of material having one side that is dimensioned to be received in said peripheral recess and having another side that is opposite said one side; wherein, said another side is also dimensioned to be received in said peripheral recess.

3. The improvement as in claim 2, wherein the seal unit further comprises:

a generally flexible seal member that is longitudinally disposed on top of said one side of the generally rigid seal member; wherein said generally rigid seal member and said generally flexible seal member are dimensioned to be received in said peripheral recess.

4. The improvement as in claim 3, wherein the replaceable seal assembly further comprises:

a bracket unit wherein the bracket unit is operatively associated with the interior of the developer station to frictionally engage said another edge of the generally rigid seal member.

5. The improvement as in claim 4, wherein the bracket unit comprises:

an elongated generally L-shaped bracket member.

6. The improvement as in claim 5, wherein the bracket member is provided with a generally vertical leg segment and a generally horizontal foot segment wherein said leg segment is operatively attached to an interior wall of the developer station such that the foot segment will frictionally engage the top of said another side of the generally rigid seal member.

7. The improvement as in claim 4, wherein the generally flexible seal member comprises a V-shaped sealing element; wherein, one of the legs of the sealing element is attached to said one side of the generally rigid seal member; and, wherein the opening in the V-shaped sealing element faces generally in the direction of said another side of the generally rigid seal member.

8. A method of installing a replaceable sealing assembly comprising a seal unit and a bracket unit into a used developer station wherein the developer station comprises a toner reservoir housing having a peripheral recess formed by the removal of the original toner reservoir seal and also having a toner inlet port and a roller housing joined along the common edges of the toner reservoir and roller housings, wherein the roller housing includes a roller assembly and a metering blade assembly; whereby the used developer station can be converted into a rechargeable developer station; wherein, the method comprises the steps of:

(a) removing the roller assembly and the metering blade assembly from the developer station;

(b) inserting the bracket unit through the opening in the developer station formerly occupied by the roller assembly and the wiper blade assembly;

(c) positioning the seal unit within the peripheral recess in the toner reservoir housing;

(d) attaching the bracket unit to the interior wall of the toner reservoir housing adjacent to said peripheral recess and an edge of the seal unit; whereby the bracket unit will frictionally engage the edge of the seal unit relative to the peripheral recess; and, (e) replacing the roller assembly and the metering blade assembly in the developer station.

* * * * *